United States Patent [19]

Grooms et al.

[11] Patent Number: 4,691,731

[45] Date of Patent: Sep. 8, 1987

[54] VACUUM SEWERAGE SYSTEM WITH IN PIT BREATHER

[75] Inventors: John M. Grooms, Rochester; Mark A. Jones, Cloverdale, both of Ind.

[73] Assignee: Burton Mechanical Contractors, Inc., Rochester, Ind.

[21] Appl. No.: 743,751

[22] Filed: Jun. 12, 1985

Related U.S. Application Data

[63] Continuation-in-part of Ser. No. 559,198, Dec. 8, 1983, abandoned.

[51] Int. Cl.[4] ..... E03F 1/00

[52] U.S. Cl. ..... 137/205; 137/236.1

[58] Field of Search ..... 137/205, 236; 4/316

[56] References Cited

U.S. PATENT DOCUMENTS

| | | | |
|---|---|---|---|
| 3,746,032 | 7/1973 | Wallgren | 137/205 |
| 3,777,778 | 12/1973 | Janu | 4/323 X |
| 4,171,853 | 10/1979 | Cleaver | 251/61.5 X |
| 4,179,371 | 12/1979 | Foreman | 137/236 R |
| 4,373,838 | 2/1983 | Foreman | 137/236 R |

*Primary Examiner*—Alan Cohan

*Attorney, Agent, or Firm*—McDougall, Hersh & Scott

[57] ABSTRACT

A vacuum sewerage transport system having a vacuum interface valve apparatus utilizing s sub-surface in-pit breathing, drainage and venting apparatus for a differential pressure controlled sensor-controller unit.

10 Claims, 6 Drawing Figures

VACUUM SEWERAGE SYSTEM WITH IN PIT BREATHER

This application is a continuation-in-part of Ser. No. 559,198 filed Dec. 8, 1983 now abandoned.

BACKGROUND OF THE INVENTION

The present invention relates generally to sewerage systems which utilize differential pressures to produce sewage transport through the system as contrasted with the more conventional gravity-operated and positive pressure sewerage systems. More particularly, the invention relates to a sub-surface in-pit breather system for a vacuum sewerage transport system and to the prevention of fluid accumulation in a valve control apparatus.

A typical vacuum sewerage system generally comprises a vacuum collection station which is connected to one or more vacuum sewers, often several miles in length. These sewers extend radially outwardly from the station and are equipped at frequent intervals with vacuum sewerage interface valves. These valves act as an interface, for example, between the vacuum sewer and one or more gravity lateral lines which may, for example, extend from a sewage source such as a residential home.

The general structure and method of operation of the vacuum valve and a sewer network utilizing such valve are described in U.S. Pat. No. 3,777,778 (Janu); U.S. Pat. No. 4,373,838 (Foreman and Grooms); and U.S. Pat. No. 4,179,371 (Foreman and Jones). Attention is also directed to U.S. Pat. No. 4,171,853 (Cleaver, et al) which describes in detail other components of a typical vacuum sewerage system.

These known vacuum sewerage systems have required direct connection of an above ground breather pipe to the vacuum interface system to prevent flooding of the controller-sensor unit by water filling the pit in which the valve is housed. All known systems prior to this invention have prevented controller-sensor flooding and failure from ground water accumulation by use of an above ground and water level air breather pipe.

However, the above round and water level air breather pipe has many disadvantages, not the least of which is the problem of aesthetics with respect to the widely varying above ground environs in which these pipes protrude. Other drawbacks include susceptibility to vandalism as well as unintended or accidental damage which may cause the vacuum interface valve to malfunction.

SUMMARY OF THE INVENTION

The invention is directed to a vacuum interface valve apparatus for a vacuum sewerage transport system. The deficiencies of prior systems are ameliorated by providing an apparatus utilizing pressure sensor means in combination with differential pressure responsive control elements with a sub-surface in-pit breather system which provides essentially atmospheric pressure for operation of the interface valve. Provision of the in-pit breather eliminates the unsightly above ground breather pipe installation and its attendant malfunctions due to accidents and vandalism. It also provides apparatus to prevent fluid accumulation in valve elements subject to fluid build-up.

Generally, a pressure differential is maintained in the system between a sewage source and a collection station. Sewage, usually at atmospheric pressure, is introduced for transport into a conduit which is maintained at relatively sub-atmospheric or vacuum pressure as is the collecting station. The differential pressure produces rapid sewage transport through the system to an ultimate collection point. When no sewage is in transport in the system, the vacuum or sub-atmospheric conduit and collecting station remain at a substantially constant low or vacuum pressure.

When a predetermined pressure head is developed by sewage accumulation in a holding tank or sump, the sensor element of a sensor-controller unit, which is connected in pressure communication with the holding tank or sump, is activated. At the selected head pressure, the sensor will activate differential pressure responsive elements of the controller portion of the unit as is fully described in U.S. Pat. No. 4,373,838. These elements will automatically control associated valve elements to produce the pressure responsive sequential opening and closing of the control valve in the vacuum line which, when opened, will permit rapid emptying of sewage from the holding tank or sump into the low pressure or vacuum conduit for sub-atmospheric pressure transport to a collecting station.

After the valve is opened and sewage introduced into the conduit, the activation of the differential pressure responsive sensor-controller and valve elements is automatically reversed to close the valve and condition the sensor-controller unit for subsequent sewage transport following reopening of the control valve as is described in detail in U.S. Pat. Nos. 4,171,853 and 4,373,838.

The vacuum sewerage transport system of the invention provides all of the advantages of prior art automatic intermittent sewage transport absent above surface breathing, venting and drainage apparatus.

DETAILED DESCRIPTION OF THE PREFERRED EMBODIMENT

Figure 1:
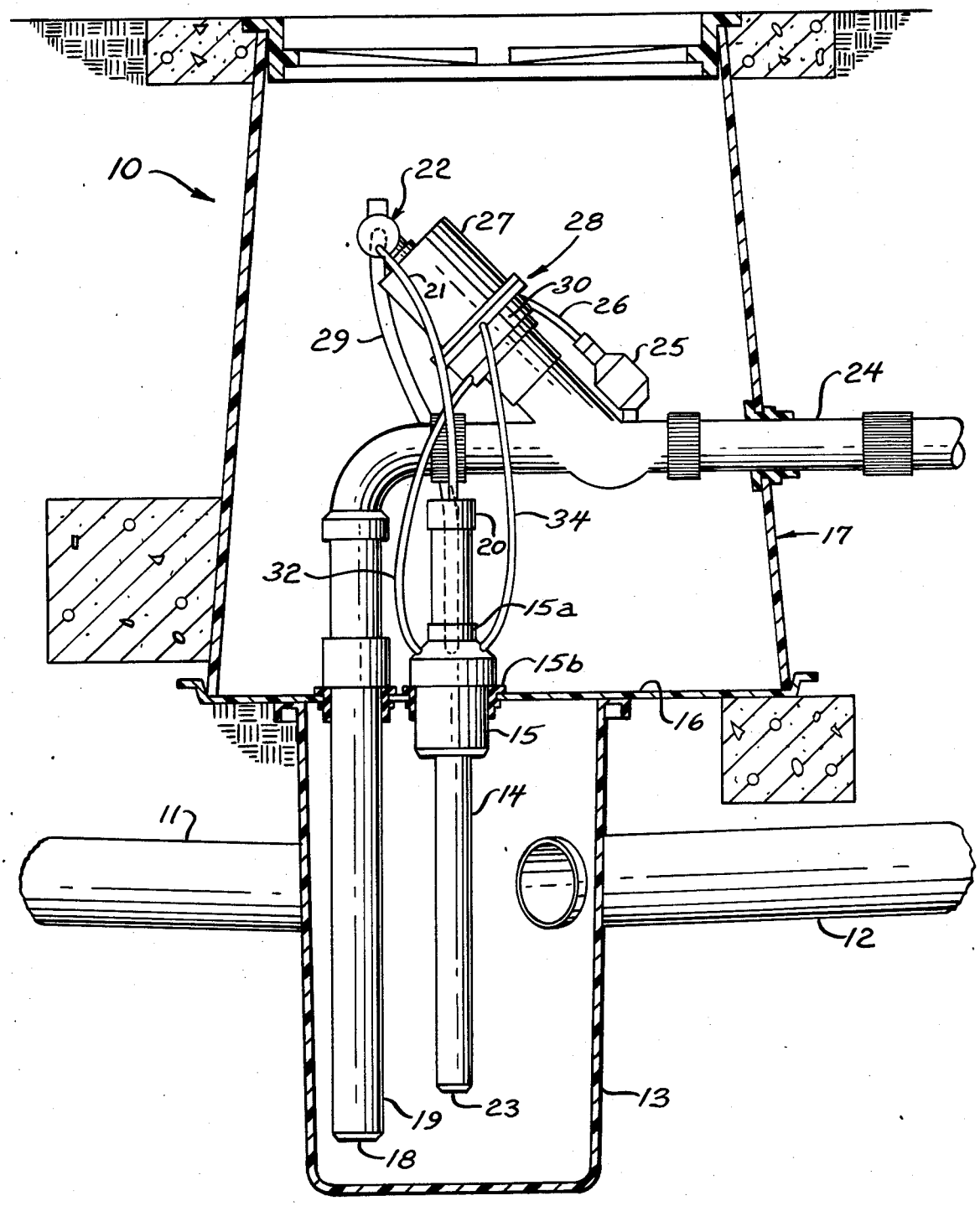
FIG. 1 is a diagrammatic representation of the vacuum sewerage interface valve and sub-surface in-pit breathing system.
Figure 3:
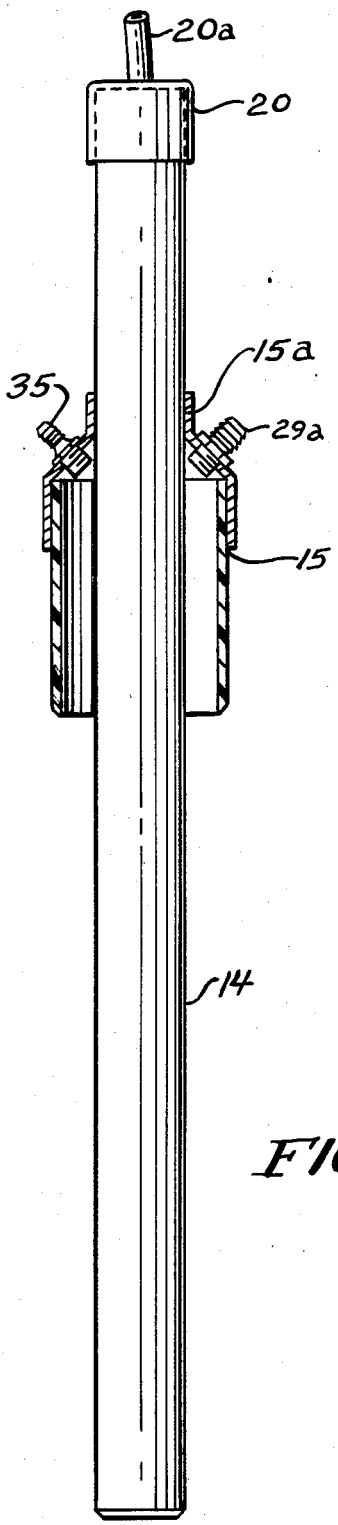
FIG. 3 is a vertical sectional view of the drain and vent element of FIG. 2 taken along lines A—A.
Figure 2:
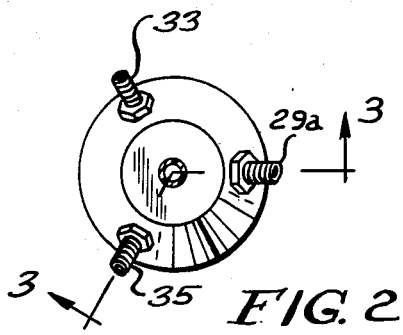
FIG. 2 is a top plan view of the drain and vent element of FIG. 1 illustrated with tubes removed.

Referring to FIGS. 1–3, a sub-surface, intermittent sewerage transport apparatus, generally designated 10, is shown connected to gravity sewer conduits 11 and 12 at atmospheric pressure. Each of these conduits drains by gravity from sewage sources such as conventional toilets in residential homes. The conduits 11 and 12 are vented to atmosphere in a conventional manner (not shown) adjacent the toilet installation in a residential home.

The initially vented conduits 11 and 12 are arranged for gravity transport of sewage to a holding tank (receptacle) or sump element 13 of transport apparatus 10. Like the vented conduits 11 and 12, the sump element 13 is ordinarily maintained at essentially atmospheric pressure by continuous communication with the vented conduits.

As shown in FIG. 1, sensor pipe 14 is supported above the bottom of the sump element 13 or receptacle by a co-axially diagonal sleeve element 15 which is secured in fluid-tight relation to pipe 14 at 15*a* and at 15*b* to the floor element 16 of housing 17. The sump element 13 and housing 17 are maintained in a water-tight separated condition by floor element 16. This relationship is carefully maintained in installations involving significant volumes of ground water to obviate continuous drainage of ground water through the sub-atmospheric transport system and resulting in ultimate flooding of the collection apparatus.

The sensor pipe 14, which is also shown in FIGS. 2 and 3, extends downward into sump 13 to a point which is spaced a predetermined distance above the inlet opening 18 of sump sewage discharge conduit 19. As can be seen in FIGS. 1 and 3, the sensor pipe 14 extends upwardly from below floor 16 of housing into the interior of the housing. The upper extremity of pipe 14 includes a cap 20 and a nipple 20*a* projecting thereform (FIG. 3). A pressure tube 21 is connected at one end to nipple 20*a* and at the other to sensor-controller unit 22 and provides continuous pressure communication between pipe 14 and the sensor-controller 22.

During typical operation of the system, sewage is discharged at essentially atmospheric pressure from one or more residential sources of commercial buildings into vented gravity conduits 11 and 12 which empty sewage into sump 13. As sewage accumulates in sump 13 to a level above the bottom opening 23 of the sensor pipe 14, a positive pressure is developed in sensor pipe 14 which is communicated through tube 21 to the sensor-controller unit 22. When the pressure reaches a predetermined level in sensor pipe 14 and is transmitted to sensor-controller unit 22, the unit 22 is activated in the manner described in detail in U.S. Pat. No. 4,373,838 and supplies a sub-atmospheric pressure or vacuum from vacuum transport conduit or line 24 connected through surge tank 25, and surge tank tube to the sensor-controller unit 22. Details as to surge tank 25 structure and operation are found in U.S. Pat. No. 4,171,853. Thus, the surge tank 25 remains in continuous communication with vacuum discharge conduit 24 to supply a continuous sub-atmospheric or vacuum source to the sensor-controller unit 22. In addition, sensor pipe 14, after the sewerage content of sump 13 has been discharged, communicates essentially the atmospheric pressure of vented gravity conduits 11 and 12 through tube 21 to sensor-controller unit 22.

Under pre-selected pressure related conditions, sensor-controller unit 22 will operate even when fully submerged in housing 17 by ground water accumulation to supply vacuum from conduit 24, surge tank 25, and tube 26, through sensor-controller unit 22 to the valve operating elements contained within upper housing 27 of the vacuum interface valve 28. As described in detail in U.S. Pat. No. 4,171,853, pressure present in upper housing 27 is released through tube 26 and surge tank 25 enabling the valve element in conduit 24 (not shown) to open and empty the content of sump 13 into the discharge conduit 24 in the manner described in the patent.

It will be noted, under normal conditions, valve 28 is closed. It is automatically opened only to remove sewage from the sump 13. Once open, valve 28 will remain open until a field adjustable timing cicruit associated with controller-sensor unit 22 reverses a valve component of the differential pressure responsive elements contained in sensor-controller unit 22 thereby reversing the sequential pressure actuating steps of the sensor-controller producing automatic pressure responsive valve closure.

To close valve 28, once opened, the upper operator elements located in the upper piston housing 27 must be at about atmospheric pressure. Atmospheric pressure is developed in housing 27 through controller-sensor unit 22 and a breather tube 29 which is connected to the upper end of sleeve element 15 and nipple 29*a* (FIGS. 2 and 3). This connection establishes communication with the essentially atmospheric pressure of the sump 13 and provides a pressure source after sewage evacuation for valve closure of line 24 through the automatic pressure responsive operation of sensor-controller 22.

The lower housing 30 of valve 28 contains shaft bearing and seal elements (not shown) through which a valve shaft (not shown) reciprocates. These elements are illustrated and described in detail in U.S. Pat. No. 4,171,853. Since both the seals and bearings are subject to wear by the reciprocating shaft, leakage may occur as sewage is discharged through the open valve causing liquid accumulation in housing 30. Natural condensation caused by the moist air in the sump 13 through communication with housing 30 through tubes 32 and 34, may accumulate in housing 30. This could ultimately result in filling of housing 30 which, under low temperature conditions, may freeze and cause a blockage such that the valve 28 would be rendered inoperable. To eliminate this problem, housing 30 is provided with a drainage tube 32 at the lowest point practicable in lower housing 30. (See, for example, U.S. Pat. No. 4,171,853, housing drainage 72.) Drainage tube 32 will act to drain any fluid leakage accumulation in lower housing 30 to sump 13 through nipple 33 (FIGS. 2 and 3) which opens through sleeve element 15 and establishes communication with the sump 13. Vent tube 34 connects the upper portion of lower housing 30 (See, for example, U.S. Pat. No. 4,171,853, housing vent 55) with sump 13 through nipple 35 which opens through sleeve element 15 and, like tube 32, provides essentially continuous communication of lower valve housing 30 with the sump 13 for continuous gravity drainage purposes.

Finally, condensation accumulation in the upper valve housing 27 of controller-sensor unit 22, caused by communication with sump 13 through tube 29, is removed during valve operation through tube 26, surge tank 25, and into discharge conduit 24.

Figure 4:
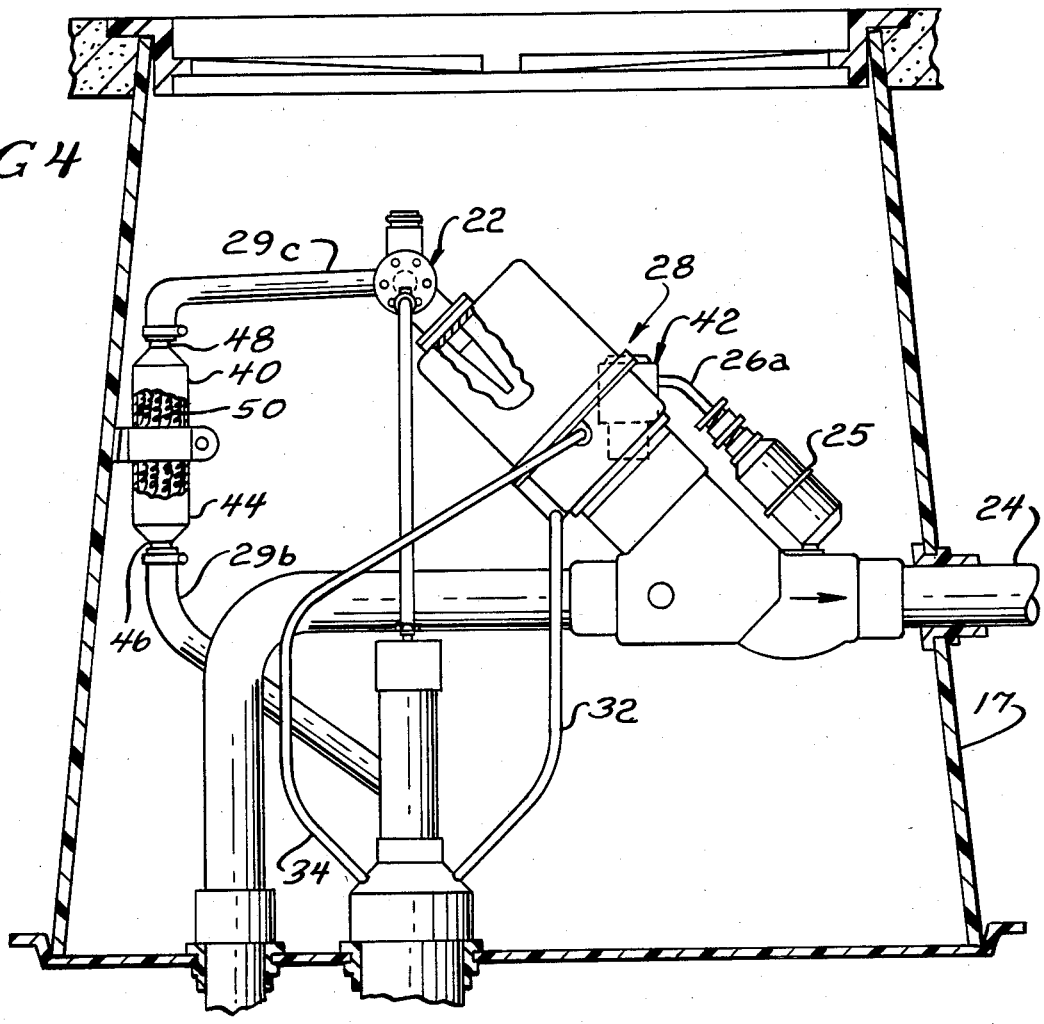
FIG. 4 is a diagrammatic representation of another embodiment of the vacuum sewerage interface valve and sub-surface in-pit breathing system having a sump vent valve.

FIG. 4 illustrates an alternate embodiment of the present invention in which a vapor trap 40 and sump vent valve 42 have been added to the apparatus of FIG. 1 described above. Vapor trap 40 defines a generally cylindrical water/air-tight housing 44 having lower and upper inlet connections 46 and 48, respectively. The interior of housing 44 is filled with a wire mesh 50, preferably stainless steel.

Trap 40 is inserted into the breather tube 29 (FIG. 1) such that the upper inlet 48 is connected to controller-sensor 22 through tube 29*c* while the lower inlet 46 is connected to sleeve nipple 29*a* through tube 29*b*. Atmospheric air for in-pit breather operation freely communicates between sump 13 and controller-sensor 22 through the vapor trap 40.

Vapor trap 40 serves to minimize or eliminate the condensation of water in the controller-sensor 22 which can otherwise occur when warm moist air from sump 13 is cooled by the lower ambient temperatures often found in housing 17. With vapor trap 40 installed, condensation occurs, instead, as the air passes through wire mesh 50—the condensed moisture, thereafter, flowing harmlessly back to sump 13 through tube 29*b*.

Figure 5:
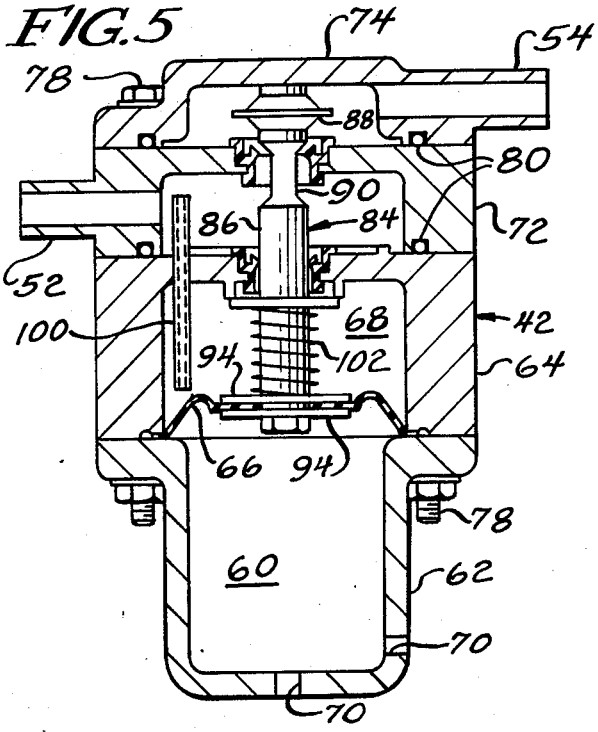
FIG. 5 is a sectional view of the sump vent valve shown in the normally operating, open position; and, FIG. 6 is a sectional view of the sump vent valve shown in the closed position.
Figure 6:
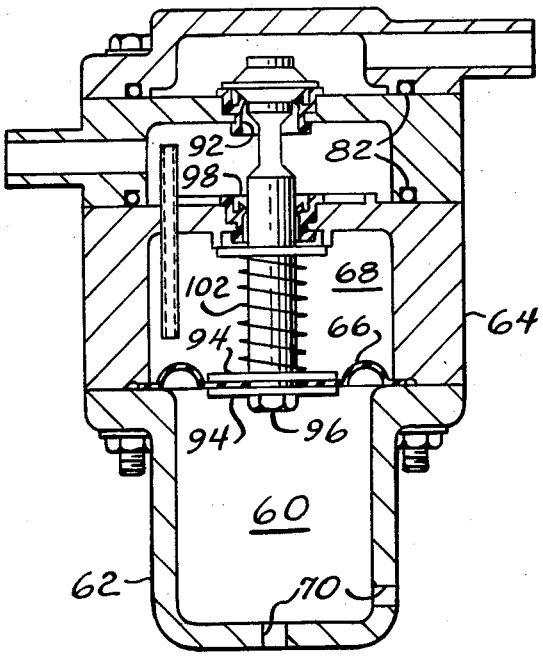

In a similar manner, sump vent valve 42 is inserted into the vacuum tube 26 (FIG. 1) interconnecting controller-sensor 22 and surge tank 25. Referring to FIGS. 4–6, sump vent valve 42 includes vacuum inlet 52 and outlet 54 operably communicating with tank 25 and controller-sensor 22, respectively. As outlined in more detail hereinafter, sump vent valve 42 functions to block free communication between controller-sensor 22 and surge tank 25 whenever system vacuum pressure in line 24 falls below a predetermined minimum operational level.

As detailed in U.S. Pat. No. 4,373,838, when insufficient vacuum is available to properly transport sewage, controller-sensor 22 maintains the main vacuum interface valve 28 in its closed position whereby gravity fed sewage will continue to collect in sump 13 until normal system vacuum is restored. In the event of an extended period of low system vacuum, sewage collecting in sump 13 has been known to back-feed through in-pit breather tube 29 (FIG. 1), in turn, into controller-sensor 22. The presence of liquid in controller-sensor 22 can preclude proper operation of this apparatus when normal system vacuum is restored. It will be appreciated that such back-feeding of sewage can only occur during extended periods of vacuum failure as sewage is emptied from sump 13 during normal system operation well in advance of the onset of back-feeding.

The above described back-feeding of sewage occurs by reason of a communication path defined through tube 29, controller-sensor 22, tube 26, surge tank 25; then, in turn, to conduit 24. Sump vent valve 42 functions to preclude such back-feeding by closing this communications path whenever system vacuum drops below the level sufficient for proper system operation. Upon closure of valve 42, air present in tubes 26,29 and in controller-sensor 22 is trapped thereby defining a barrier to the upward flow of sewage in tube 29.

FIGS. 5 and 6 illustrate valve 42 in its open and closed positions, respectively. Valve 42 includes a reference chamber 60 defined within a cup-shaped lower housing member 62. A second cup-shaped intermediate housing member 64 is mated in sealing relationship to lower housing member 62 with respective open ends in facing relationship. A diaphram 66, sandwiched between housing members 62 and 64, separates reference chamber 60 from vacuum chamber 68 defined within intermediate housing member 64 and, further, the diaphram serves as a seal between the housing members. Holes 70 are provided in lower housing 62 to vent reference chamber 60.

Two additional cup-shaped housing members 72 and 74 define the overall valve housing. Housing member 72 is oriented adjacent to, and above, intermediate housing member 64 and is provided with a vacuum inlet 52 operatively connected to surge tank 25. Finally, housing member 74 defines the uppermost portion of the valve housing and includes the vacuum outlet 54 connected to the vacuum inlet of controller-sensor 22. The four housing members 62, 64, 72, and 74 are retained along a common axis by a plurality of bolts 78. Annular channels 80 are formed in mating surfaces of housing members 72 and 74. These channels are fitted with O-rings 82 which, in conjunction with diaphram 66, define air and liquid-tight valve housing seals.

Housing members 64 and 72 each include an aperture along the central axis through which a valve plunger 84 is permitted to reciprocally move. More specifically, plunger 84 defines a molded plastic shaft 86 having an integral cylindrical bevelled flange member 88 at the upper end thereof and a pair of opposed depressions 90 below flange 88. A rubber seal 92 is fitted into the aperture of housing 72 which, in turn, receives plunger flange 88 in sealing engagement when valve 42 is closed (FIG. 6). When valve 42 is open, as depicted in FIG. 5, communication of vacuum pressure is permitted between inlet 52 and outlet 54 through seal 92. The plunger depressions 90 serve to enlarge the available opening thereby to augment communication therethrough.

Diaphram 66 is sandwiched between a pair of plastic washers 94 which, in turn, are rigidly affixed to the lower end of plunger 84 by screw 96. A rubber seal 98 is provided in the aperture of housing member 64 through which plunger 84 reciprocally operates. A plastic tube 100 extends through housing member 64 from pressure chamber 68 into the vacuum inlet chamber defined within housing member 72. A compression spring 102 is positioned over plunger 84 adjacent diaphram 66. In the absence of vacuum pressure, spring 102 downwardly biases the plunger within the housing thereby causing flange 88 to seat within seal 92 as shown in FIG. 6.

Operationally, valve 42 remains closed until sufficient vacuum pressure is applied to vacuum inlet 52. Such vacuum is communicated through tube 100 thereby lowering the pressure, in chamber 68, on the upper side of diaphram 66. The pressure on the lower side of the diaphram, i.e. in reference chamber 60, remains substantially unchanged at atmospheric pressure. The resulting differential pressure acting on diaphram 66 causes upward movement of the plunger, once the biasing force of spring 102 is overcome, which, in turn, opens valve 42. Spring 102 sets the threshold vacuum pressure required to open the valve which is generally selected to cause valve closure where insufficient pressure is available for main valve activation. In this manner the communication through vacuum tube 26 is interrupted thereby blocking the back-feed of sewage into controller-sensor 22 occasioned by the accumulation of sewage in sump 13 during periods of system vacuum shutdown.

What is claimed is:

1. Apparatus for sewage flow control in a normally sub-atmospheric pressure sewerage transport system comprising:

a sewage accumulation receptacle for sub-surface installation and for collecting sewage for discharge into the transport system, the receptacle being adapted for sub-surface connection to conduit means communicating with a remote pressure source to maintain the receptacle before and after discharge at a pressure level above the normal sub-atmospheric pressure of the transport system, a differential pressure operated flow control valve adapted to sequentially open and close in response to pre-selected pressure levels and to facilitate the discharge of sewage from the receptacle into the sewerage transport systems, and means between the valve and the receptacle for sub-surface installation and to provide continuous communication of at least two pressures developed in the receptacle with the differential pressure operated flow control valve for sequential operation thereof, one of the pressures including the pressure level above normal sub-atmospheric pressure maintained in the receptacle through its connection to the remote pressure source whereby the receptacle and the differential pressure operated control valve may be maintained entirely sub-surface without air vent or other conduits openly protruding above grade level.

2. The apparatus of claim 1 wherein the means between the valve and the receptacle comprise:

a first conduit between the valve and the receptacle for transmitting a first pressure to differential pressure operated flow control valve which pressure is related to the quantity of sewage contained by the receptacle for automatic pressure responsive sequential operation of the flow control valve, and a second conduit between the valve and the receptacle for continuously transmitting a second pressure to the valve at the pressure level above normal sub-atmospheric pressure maintained in the receptacle through its connection to the remote pressure source.

3. The apparatus of claim 1 wherein the means between the valve and the receptacle include conduit means connected in communication with the flow control valve uniquely functioning to facilitate fluid drainage from valve components of the sewerage transport system.

4. In a normally sub-atmospheric pressure sewerage transport system, an intermittent sewerage transport apparatus comprising:

a sub-surface sewerage accumulation receptacle for sewage collection for discharge into the transport system, a first sewerage conduit having a sub-surface connection to the receptacle for delivery of sewage to the receptacle, means positioned remotely with respect to the receptacle and in sub-surface communication therewith to continuously provide the receptacle with pressure at a level above that of the transport system, a differential pressure operated flow control valve having pressure responsive operating elements connected in pressure communication with the receptacle and a conduit at sub-atmospheric pressure in the sewerage transport system, the pressure responsive elements of the valve being operable in response to a pressure increase produced by sewage accumulation in the receptacle to open the valve and, by the action of differential pressures in the receptacle and sub-atmospheric conduit, to discharge the sewage contents from the receptacle past the open valve and into the sub-atmospheric conduit, and sub-surface conduit means disposed between the valve and the receptacle to provide pressure communication between the receptacle and valve operating elements at pressure levels exceeding that of the sub-atmospheric pressure conduit to produce the sequential opening and closing of the valve in response to pressures developed in the receptacle, the pressures including the pressure level above normal sub-atmospheric pressure continuously provided in the receptacle through its connection to the remote pressure means.

5. The system of claim 4 wherein the pressure continuously provided to the receptacle is substantially atmospheric.

6. The system of claim 5 wherein means are provided for transmitting a pressure increase in excess of atmospheric pressure in the receptacle produced by sewage accumulation to the valve to initiate the opening thereof.

7. The system of claim 4 wherein the pressure communication between flow control valve operating elements and the receptacle is established by a first conduit for transmitting a first pressure to the flow control valve which pressure is related to the quantity of sewage contained by the receptacle, and by a second conduit for continuously supplying a second pressure to the valve at a level above that of the sub-atmospheric level of the transport system.

8. The apparatus of claim 4 wherein the pressure communication between flow control valve operating element and the receptacle include conduit means connected in communication with the valve uniquely functioning to facilitate fluid drainage from valve components of the sewerage transport system.

9. The apparatus of claim 2 including means disposed in the second conduit between the valve and the receptacle for trapping vapor.

10. Apparatus for sewage flow control in a normally sub-atmospheric pressure sewerage transport system comprising:

a sewage accumulation receptacle for sub-surface installation and for collecting sewage for discharge into the transport system;

the receptacle being adapted for connection to conduit means communicating with a remote pressure source to maintain the receptacle before and after discharge at a pressure level above the normal sub-atmospheric pressure of the transport system;

a differential pressure operated flow control valve adapted to sequentially open and close in response to pre-selected pressure levels and to facilitate the discharge of sewage from the receptacle into the sewerage transport systems, conduit means operatively connecting the differential pressure operated valve to subatmospheric pressure of the sewage transport system;

means between the valve and the receptacle for sub-surface installation and to provide continuous communication of the pressures developed in the receptacle with the differential pressure operated flow control valve for sequential operation thereof, the pressures including the pressure level above normal sub-atmospheric pressure maintained in the receptacle through its connection to the remote pressure source; and, sump vent valve means disposed in said sub-atmospheric pressure conduit means adapted to inhibit fluid flow in the direction toward the normal source of sub-atmospheric pressure of the sewage transport system when the sub-atmospheric pressure rises above a predetermined minimum sub-atmospheric level.

* * * * *